US006308340B1

(12) United States Patent
Cook

(10) Patent No.: US 6,308,340 B1
(45) Date of Patent: Oct. 30, 2001

(54) UNDERPANTS WITH AN INSIDE POCKET

(76) Inventor: Rhonda Cook, 1626 Clark Lake Dr., Acworth, GA (US) 30102

( * ) Notice: Subject to any disclaimer, the term of this patent is extended or adjusted under 35 U.S.C. 154(b) by 0 days.

(21) Appl. No.: 09/662,496

(22) Filed: Sep. 14, 2000

(51) Int. Cl.[7] ..... A41B 9/00
(52) U.S. Cl. ..... 2/400; 2/406
(58) Field of Search ..... 2/400, 401–408, 2/78.1, 227, 228, 238, 79, 455, 456, 466, 214, 215; 450/153; 604/396–398

(56) References Cited

U.S. PATENT DOCUMENTS 3,310,053 * 3/1967 Greenwood ..... 2/101
3,871,030 * 3/1975 Green ..... 2/238
5,093,935 * 3/1992 Countee, Jr. ..... 2/400
5,172,430 * 12/1992 Lerma-Solis ..... 2/400
5,920,914 * 7/1999 Dempsey ..... 2/403
6,018,823 * 2/2000 Ortmeier ..... 2/406
6,041,445 * 3/2000 Davitt ..... 2/400
6,076,195 * 6/2000 Klein ..... 2/400

* cited by examiner

*Primary Examiner*—Gloria M. Hale
(74) *Attorney, Agent, or Firm*—John L. James

(57) ABSTRACT

An inside pocket is formed in a pair of underpants by attaching an inside panel to the front portion of the underpants. The pocket is open at the top to receive a spare sanitary napkin which is carried horizontally in the pocket during the menses.

4 Claims, 1 Drawing Sheet

UNDERPANTS WITH AN INSIDE POCKET

FIELD OF THE INVENTION

The present invention relates generally to undergarments, and more particularly, to a woman's underpants useable during menstruation.

BACKGROUND OF THE INVENTION

A woman typically uses an absorbent napkin, tampon or other sanitary device to control the menses. Because the menses lasts for several days at a time, it is necessary to change the device during the course of the menses. The frequency of change varies but most women find it necessary or desirable to change the device while at work or at other settings where others are present. While the actual change can be made in privacy in a bathroom, the trip to the bathroom is noticeable, which can be embarrassing. This is especially so when a woman normally journeys to the bathroom without her purse, but has the purse when the menstrual device is to be changed. The purse is generally necessary because women's clothes are normally void of useful pockets. Accordingly, it will be appreciated that it would be highly desirable to have a way to carry sanitary devices unnoticed.

SUMMARY OF THE INVENTION

The present invention is directed to overcoming the problem of carrying a concealed sanitary device to maintain privacy during the menses. According to one aspect of the present invention, a woman's underpants comprises front and rear portions, a crotch portion and an inner panel. The front portion has an inside and an outside. The front and rear portions define a waist opening for fitting about the lower torso of a woman with the inside of the front portion adjacent the torso. The crotch portion connects the front and rear portions. The front, rear and crotch portions define first and second leg openings for receiving the legs of a woman when the underpants are worn about the lower torso of a woman. An inner panel attached to the inside of the front portion forms a pocket inside the underpants.

The pocket provides a place for carrying a sanitary item making it unnecessary for a woman to carry a purse. The purse is normally necessary because women's fashions are very often void of useful pockets. The pocket provides a way to carry sanitary devices unnoticed to thereby maintain privacy.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 3:
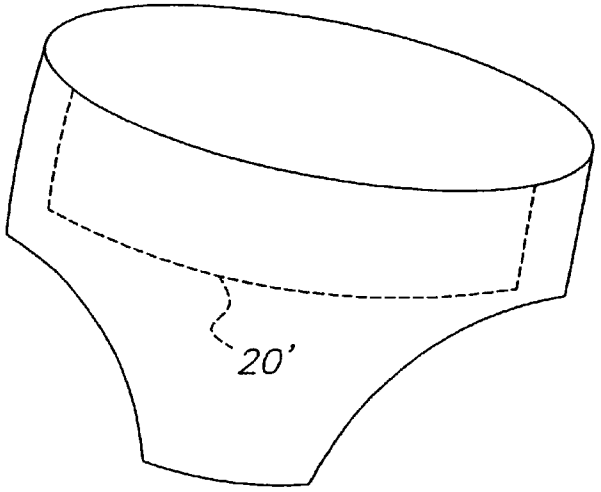
FIG. 3 is a perspective view similar to FIG. 1 but illustrating another embodiment.
Figure 2:
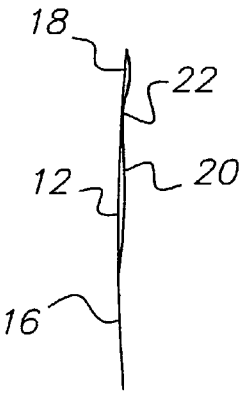
FIG. 2 is a sectional view taken along line 2—2 of FIG. 1.
Figure 1:
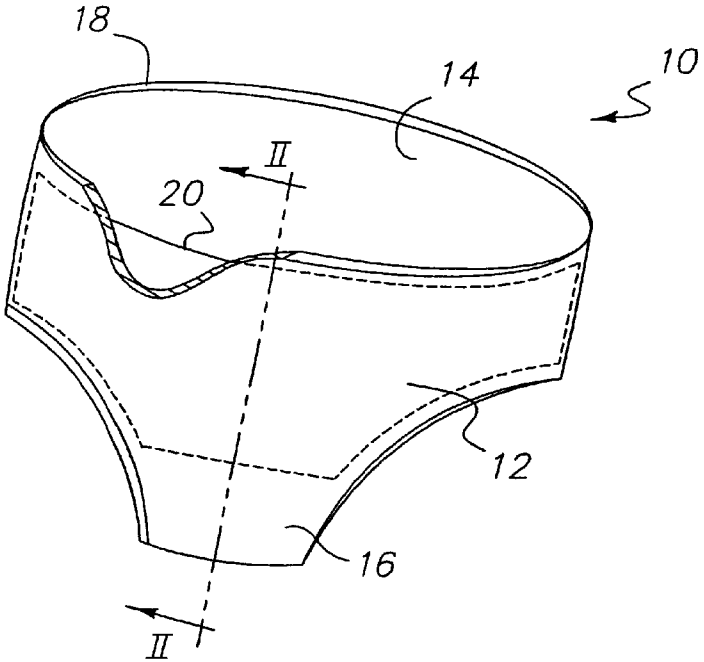
FIG. 1 is a perspective view of a preferred embodiment of a panty incorporating a pocket according to the present invention.

Referring to FIGS. 1–3, a woman's underpants 10 have a front portion 12, a rear portion 14 and a crotch portion 16. The front portion 12 has an inside worn next to the body and an outside. The front and rear portions 12, 14 define a waist opening for fitting about the lower torso of a woman. A waistband 18 at the tops of the front and rear portions fits about the waist and preferably contains rubber or other elastomeric material for a more comfortable fit. The crotch portion 16 connects the front and rear portions with the front, rear and crotch portions defining left and right leg openings for receiving the legs when the underpants are worn about the lower torso of a woman.

Referring to FIGS. 1–2, an inner panel 20 is attached to the inside of the front portion 12 forming a pocket 22 inside the underpants. The inner panel 20 extends upward to the waist opening and extends downward to the crotch portion. Inner panel 20 may extend the entire width of the front portion or may only extend enough to provide sufficient room for carrying a sanitary napkin in the pocket. Inner panel 20 may be attached by sewing it to the front portion leaving the top unstitched to provide access to the pocket formed. Where the front and rear portions form a seam, inner panel 22 may be incorporated in the seam. Similarly, lower edges of the inner panel 22 may terminate in a single seam with the front panel at the leg openings.

Referring to FIG. 3, an inner panel 20' is attached to the inside of the front portion 12' above the leg openings. This placement allows room for a sanitary napkin oriented horizontally. More than one horizontally oriented sanitary napkin can be carried at a time depending upon the size of the undergarment and length and thickness of the sanitary napkin.

Operation of the present invention is believed to be apparent from the foregoing description and drawings, but a few words will be added for emphasis. After the undergarment is positioned on the body, the waistband is pulled away from the body to open the pocket. The sanitary items are inserted into the pocket and the waistband is released. When the sanitary item is needed, the waistband is pulled away from the body to open the pocket.

While the invention has been described with particular reference to the preferred embodiments, it will be understood by those skilled in the art that various changes may be made and equivalents may be substituted for elements of the preferred embodiments without departing from invention. For example, while the invention has been described with particular reference to sanitary napkins, it is equally suited for tampons and other devices. It is accordingly intended that the claims shall cover all such modifications and applications as do not depart from the true spirit and scope of the invention.

What is claimed is:

1. A woman's underpants, comprising:

a front portion having an inside and an outside;

a rear portion, said front and rear portions defining a horizontally oriented waist opening for fitting about the lower torso of a woman with said inside of said front portion adjacent the torso;

a crotch portion connecting said front and rear portions and having, said front, rear and crotch portions defining first and second leg openings for receiving the legs of a woman when the underpants are worn about the lower torso of a woman; and an inner panel attached to said inside of said front portion forming a horizontally oriented pocket inside said underpants for carrying a horizontally oriented sanitary device, said inner panel being positioned above said leg openings so that the lowest portion of said inner panel is at a higher elevation than the highest portion of said leg openings.

2. A woman's underpants, as set forth in claim 1, wherein said inner panel extends upward to said waist opening.

3. A woman's underpants, comprising:

a front portion having an inside and an outside;

a rear portion, said front and rear portions defining a waist opening for fitting about the lower torso of a woman with said inside of said front portion adjacent the torso;

a crotch portion connecting said front and rear portions and having, said front, rear and crotch portions defining first and second leg openings for receiving the legs of a woman when the underpants are worn about the lower torso of a woman; and an inner panel attached to said inside of said front portion above said leg openings forming a horizontally oriented pocket inside said underpants so that the lowest portion of said pocket is at a higher elevation than the highest portion of said leg openings.

4. A woman's underpants, as set forth in claim 3, wherein said inner panel extends upward to said waist opening and downward along said front panel above said crotch panel to thereby reduce interference with an in use sanitary device.

* * * * *